US005839940A

United States Patent [19]

Ensmenger

[11] Patent Number: 5,839,940

[45] Date of Patent: Nov. 24, 1998

[54] PRESSURIZED GAS/WATER ROCKET AND LAUNCHER THEREFOR

[76] Inventor: Gary E Ensmenger, 18064 First Ave., Orlando, Fla. 32820

[21] Appl. No.: 791,468

[22] Filed: Jan. 27, 1997

[51] Int. Cl.[6] ..... A63H 27/26

[52] U.S. Cl. ..... 446/212; 124/57

[58] Field of Search ..... 446/211, 212, 446/56; 124/56, 61, 63, 69, 70, 57, 75; 89/1.818

[56] References Cited

U.S. PATENT DOCUMENTS

| | | | |
|---|---|---|---|
| 2,733,699 | 2/1956 | Krinsky . | |
| 2,759,297 | 8/1956 | Lewis | 446/212 |
| 2,927,398 | 3/1960 | Kaye et al. . | |
| 3,046,694 | 7/1962 | Holderer | 446/212 |
| 3,091,052 | 5/1963 | Ryan | 124/56 X |
| 3,740,896 | 6/1973 | Glass et al. . | |
| 3,962,818 | 6/1976 | Pippin, Jr. . | |
| 4,223,472 | 9/1980 | Fekete et al. . | |
| 4,411,249 | 10/1983 | Fogarty et al. . | |
| 4,897,065 | 1/1990 | Fertig et al. . | |
| 5,032,100 | 7/1991 | Goldfarb . | |
| 5,415,153 | 5/1995 | Johnson et al. . | |

FOREIGN PATENT DOCUMENTS

| | | | |
|---|---|---|---|
| 161579 | 5/1954 | Australia | 446/212 |
| 1330882 | 5/1963 | France | 446/212 |

*Primary Examiner*—Mickey Yu
*Attorney, Agent, or Firm*—Eric P. Schellin

[57] ABSTRACT

The present invention is directed to a liquid jet propelled rocket launcher and rocket. More specifically, it is directed to a toy which propels a rocket in a generally upward direction by a liquid-gas propulsion combination. Further, the present invention utilizes a rocket with a liquid reservoir, and in one embodiment an air pump supplies pressurized air into the rocket which has been previously charged with water while in its launch position, and the rocket is subsequently launched by a manually operated trigger mechanism. In another embodiment dry ice is introduced into the rocket's water containing reservoir and is thereby charged with gaseous carbon dioxide as the dry ice sublimates. In a third embodiment water and dry ice are charged into a container from whence the water and pressurized carbon dioxide is flowed through a conduit to charge a rocket. In a fourth embodiment baking soda is put into the reservoir of the rocket and water containing an organic acid and water are introduced into the reservoir of the rocket thereby releasing carbon dioxide gas for pressurization. In still another embodiment dry baking soda and a powdered dry organic acid is introduced into the reservoir of the rocket. The reservoir is filled with water as before.

8 Claims, 4 Drawing Sheets

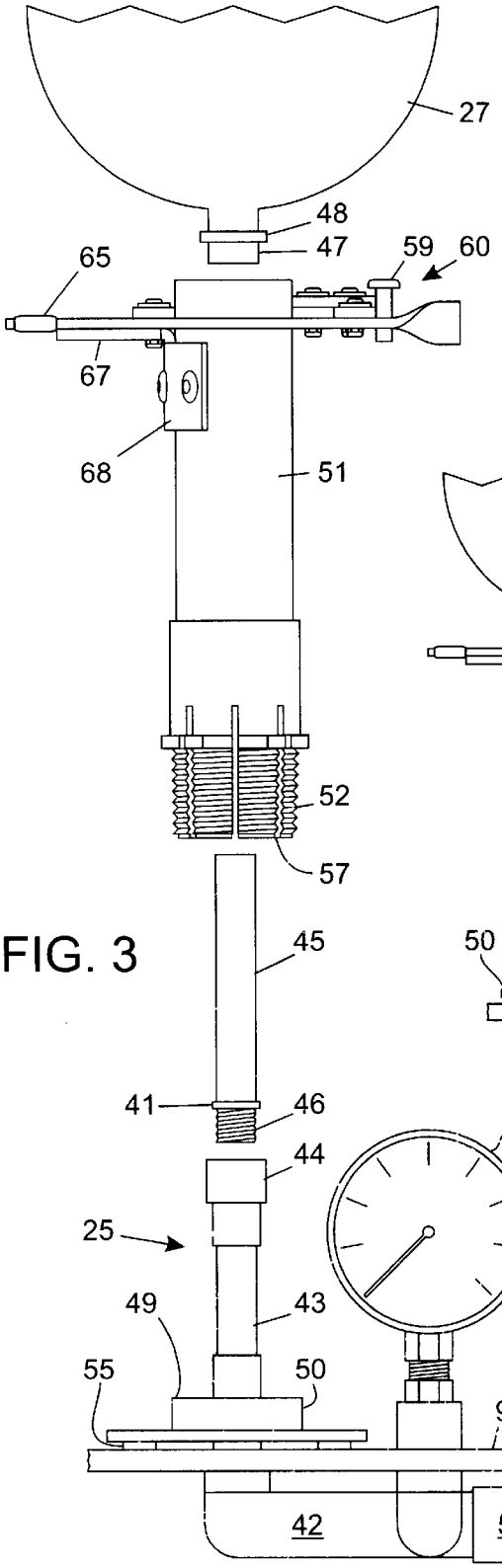
FIG. 3
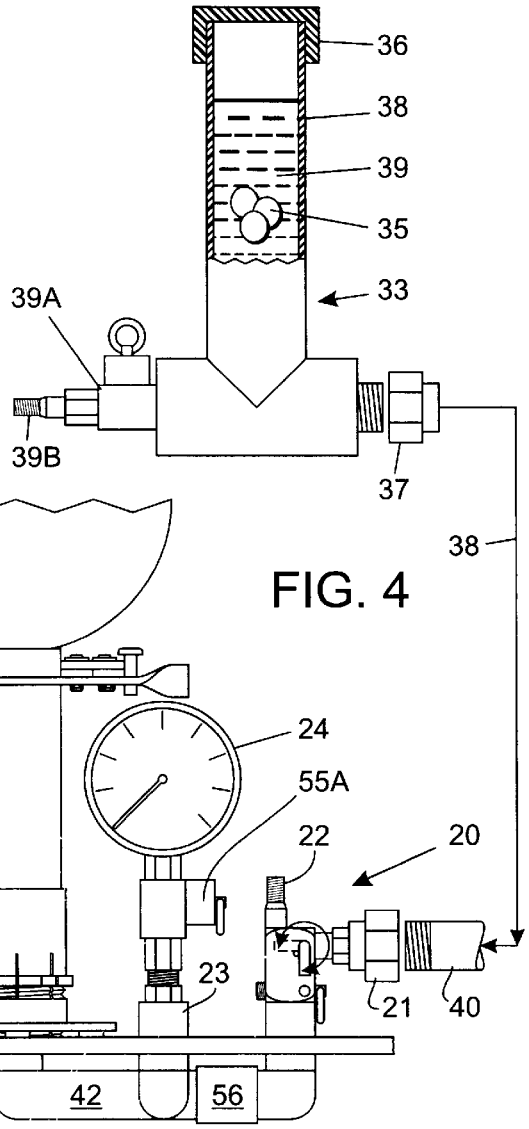
FIG. 4
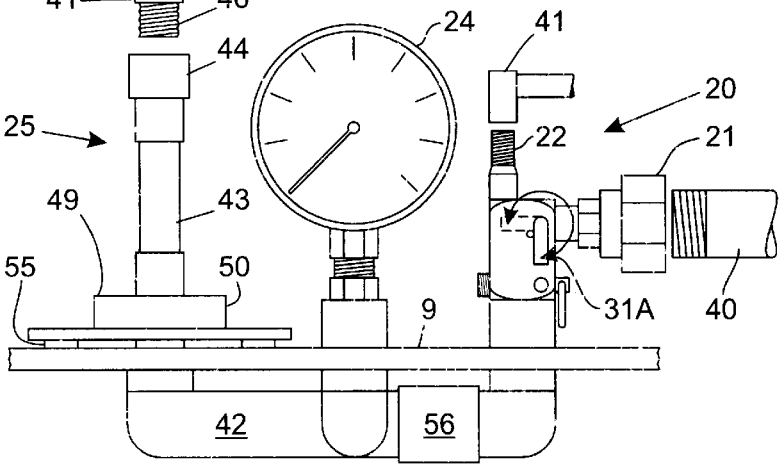

PRESSURIZED GAS/WATER ROCKET AND LAUNCHER THEREFOR

BACKGROUND OF THE INVENTION

1. Field of the Invention

The present invention is directed to a liquid jet propelled rocket launcher and rocket. More specifically, it is directed to a toy which propels a rocket in a generally upward direction by a liquid-gas propulsion combination. Further, the present invention utilizes a rocket with a liquid reservoir, and in one embodiment an air pump supplies pressurized air into the rocket which has been previously charged with water while in its launch position, and the rocket is subsequently launched by a manually operated trigger mechanism. In another embodiment dry ice is introduced into the rocket's water containing reservoir, either before the water or after the water is added, and is thereby charged with gaseous carbon dioxide as the dry ice sublimates. In a third embodiment water and dry ice are charged into a container from whence the water and pressurized carbon dioxide is flowed through a conduit to charge a rocket. In a fourth embodiment baking soda is put into the reservoir of the rocket and water containing an organic acid and water are introduced into the reservoir of the rocket thereby releasing carbon dioxide gas for pressurization. In still another embodiment dry baking soda and a powdered dry organic acid is introduced into the reservoir of the rocket. The reservoir is filled with water as before.

2. Prior Art Statement

Toys involving launchers have been around for at least thirty or forty years and apparently emerged with modern rocketry, although not all such toys pertain directly to rockets. Over the years various types of jet-powered toys have been developed which rely upon pressurized liquid within a container in the projectile or transporter and/or rely upon pressurized gaseous medium launching.

U.S. Pat. No. 2,733,699 issued to B. Krinsky describes a rocket toy using a pressurized launcher and a spring mechanism for initial thrust. Pressurized air is created by a hand pump and a resilient washer is used to retard launching until adequate pressure is achieved.

U.S. Pat. No. 2,927,398 issued to Kaye et al describes a multi-stage rocket in which fluid within chambers in each of multiple stages of a rocket are pressurized and sequentially released. Similarly, U.S. Pat. No. 3,962,818 issued to Reginald Pippin describes a multi-stage rocket with mechanisms for pressurizing liquid within containers for each stage.

U.S. Pat. No. 3,740,896 issued to Marvin Glass et al describes a jet-powered vehicle wherein a wheeled vehicle has a chamber or container within it and has a launching device which includes an air pump with a one-way valve. There is also clamp means for holding the vehicle in the charging position and a trigger means for releasing the clamping device following the charging of the chamber to permit the vehicle to be propelled by means of reaction of the jet drive.

U.S. Pat. No. 4,223,472 issued to Fekete et al describes a toy missile launching device which utilizes pressurized air. It involves a complex system which includes a large launching guide pipe, a complex mechanical release mechanism and a three position valve member for complex pumping and launching.

U.S. Pat. No. 4,411,249 issued to Bonnie Fogarty et al describes a toy glider with a pneumatic launcher. In this device, a wristlet includes a pumping mechanism as well as a flexible conduit to which a glider may be attached. The pump is used to pressurize and pneumatically project the glider.

U.S. Pat. No. 4,897,065 issued to John Fertig describes a toy vehicle and hand held pneumatic launcher wherein the pumping mechanism has a piston and hollow cylinder designed for a particular type of grip of a child coupled with thumb or hand operation of the pump mechanism.

U.S. Pat. No. 5,032,100 issued to Adolf Goldfarb describes a toy vehicle and launcher which uses contractive power of liquid in a liquid expanded chamber to propel the vehicle. Here, a significally large reservoir is utilized to fill and expand a bladder which is connected to and part of a transporter or toy vehicle. It is the expanded, pressurized bladder with the air and water mixture which propels the vehicle as a result of the contraction of the bladder upon release of the vehicle.

U.S. Pat. No. 5,415,153 issued to Johnson et al describes a liquid jet propelled rocket wherein water is poured into the reservoir of a rocket; the rocket is then inverted on a launch pad and the reservoir of the rocket is then further pressurized by air. The rocket has a latch mechanism located on a housing with means for releasing the latch. The water in the rocket reservoir is pressurized by means of a pump.

Notwithstanding the prior art in this field, no prior art reference teaches or renders obvious the present invention device which utilizes a pressurized launcher with a rocket which has a reservoir which holds a predetermined volume mixture of water and gas, such as air to maximize a jet propulsion upon launching.

SUMMARY OF THE INVENTION

The present invention involves a liquid jet propelled rocket and rocket tripod type launcher. As an example, the rocket is constructed of a two liter soda bottle. The bottle is launched while in an upside down position. As the ordinary bottle is rounded at its bottom a cone member is attached to the bottle opposite to the neck end to provide stream lining. To keep the rocket on a trajectory the bottle is fitted with three fins, also more fins may be included if within sound aeronautical principles.

The cone member may be constructed of the upper portion of a conventional soda bottle which has its lower portion cut-off. The upper portion is nested and adhesively secured to the inverted bottom portion of the soda bottle constituting the reservoir for the rocket. The mouth of the said upper portion is useful for introducing therethrough a substance which supplies weight to the top of the rocket enhancing control and distance of the trajectory.

The water or other liquid is introduced into the reservoir by means of a stand pipe that extends with a friction fit through the mouth of the inverted reservoir bottle for a substantial distance terminating near the bottom of the inverted reservoir bottle from whence the water over flows. The stand pipe besides being a filling conduit also acts as a guide for the rocket during its initial lift-off or take-off.

It is contemplated that the cone may be fitted with items other than weight supplying substances prior to the cone's mouth being sealed with a conventional screw-on cap. For instance, parachute could be mounted in the cone with a suitable cap removal system and parachute deployment means. Monitoring-recording devices are also within the purview of the insertion for introduction into the nose cone whereby the speed, trajectory, distance etc. may be obtained.

As various volumes of the soda bottles may be employed, it is contemplated that various lengths of stand pipes will be necessary. Likewise, it is contemplated that the mouth openings of the bottles will vary, so that the outside diameter of the standpipe will also vary. Suitable fitments can be supplied to the conduit carrying the water to the launcher.

The launcher of the present invention includes hinged outrigger foldable arms on either sides of the launcher inclining the upper surface of a housing whereby the rocket may be launched at a predetermined angle. In line therewith, the launcher may also be stood up on its end and the hinged outrigger foldable arms may be modified with a bracket to supply support in a position whereby the standpipe is in a substantially horizontally disposed position. In such position the standpipe is fitted into a similar soda bottle as heretofore except that the bottle is mounted on a toy wheeled vehicle. The wheeled vehicle, when appropriately charged and released, all as heretofore, is propelled horizontally along a pathway.

BRIEF DESCRIPTION OF THE DRAWINGS

The present invention as described herein will be more fully understood and appreciated when taken in conjunction with the drawings appended hereto those drawings are as follows:

FIG. 3 is a side view of a partially exploded rocket, launcher and its housing;

FIG. 4 is a similar view, substantially assembled of another embodiment;

DETAILED DESCRIPTION OF THE INVENTION

The present invention toy has been developed to create a rocket which is jet propelled and which is launched from a unique launcher preferably utilizing a mixture of liquid (typically water) and gas, (typically air) in a predetermined ratio, in a rocket reservoir and enabling the user to effectively accomplish this in a manner which utilizes air pressure built up in the rocket, followed by jet propulsion caused by pressurized gas with water exiting from the rocket for thrust. Uniquely, the present invention toy includes a launcher which has a series of conduits for flowing water and pressurized air to the underside of a rocket and into a reservoir. The rocket reservoir has a volume for a predetermined amount of liquid, with space remaining for air and subsequent further pressurization.

Figure 1:
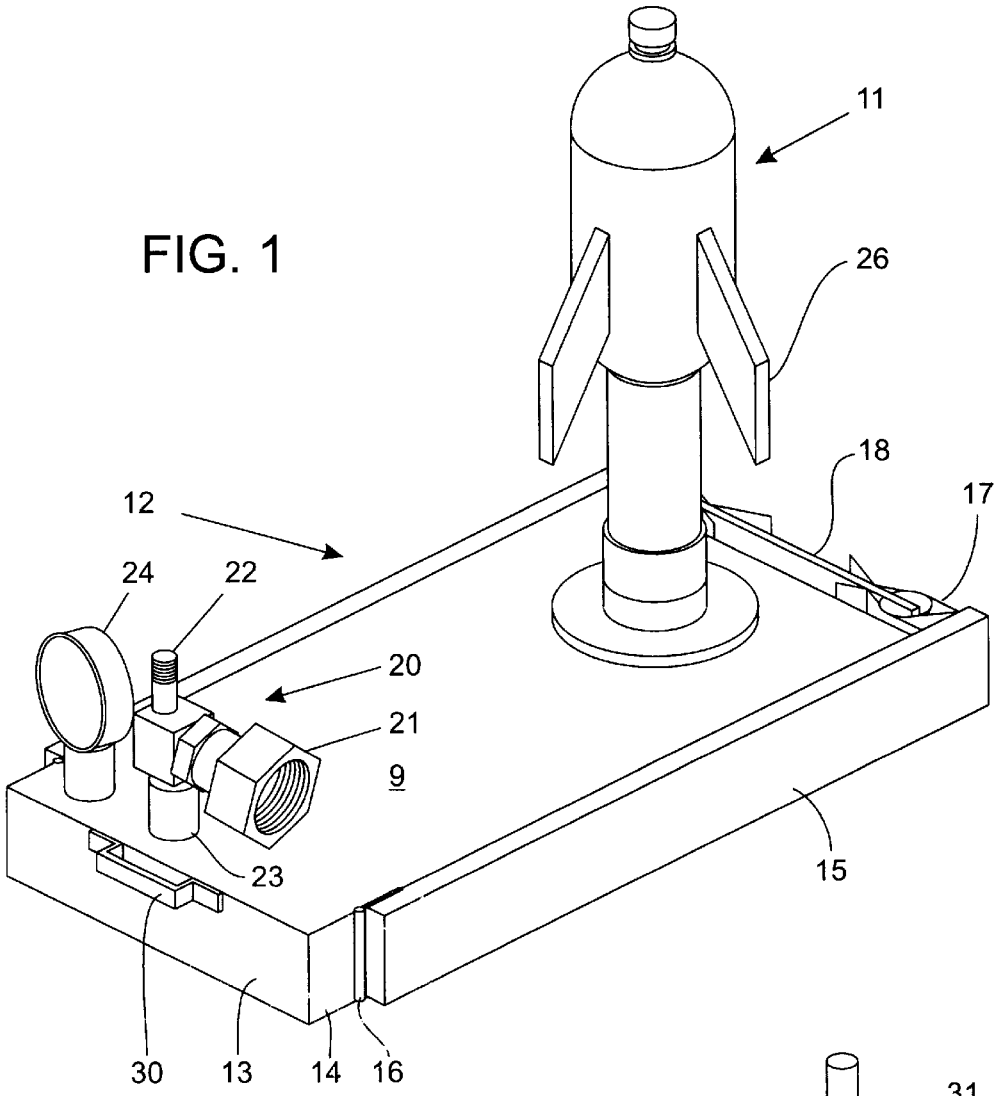
FIG. 1 is perspective of the rocket launches with a rocket in place.

Referring now to the figures, there is shown in a perspective view of the present invention toy, generally, 11 and a launcher 12. The launcher has a rectangular housing 9 having shorter end walls 13 and longer side walls 14. Each of the side walls has hingedly attached thereto an elongated outrigger leg 15. The hinge 16 is shown as being somewhat close to one of the shorter end walls 13. In FIG. 1 the legs 15 when closed are seen to be parallel to the longer side walls 14. The end portions of the legs 15 extending beyond the housing 9 have spring loaded brackets 17 mounted to face each other in the portion extending beyond the housing 9. Each of the brackets 17 is seen to grasp the end of a relatively small plate 18 and in doing so retain the legs in the folded position shown in FIG. 1.

A Tee-connection 20 is mounted at one end portion of the housing 9. Its location is chosen whereby it does not interfere with the fins of the rocket 11 when the latter is on its to-be-launched site. The Tee-connection 20 has a female threaded connector 21 facing horizontally adapted to fit the male fitting, shown in FIG. 3, of a conventional water hose. The Tee-connection 20 has a male connector 22 adapted to be fitted to the end of a female connector of a conventional air pump (not shown) The male connector 22 has a conventional spring ball valve urged in the normally closed position.

The Tee-connection 20 feeds through conduit 23 into a conduit in the housing. Said conduit 23 has a pressure gauge 24 extending through the housing 9 for viewing. Internally of the housing 9 is a further conduit 42 which feeds the launcher means 25 near the other end of the housing 9. More will be said of said conduits in connection with FIGS. 3 and 4.

The launcher means 25 has mounted thereon a rocket 11. The rocket 11 is constructed of an inverted two liter soda bottle, as a preferred embodiment, although larger or smaller volumetric versions may be employed. In one embodiment, the rocket may consist of a single two liter soda bottle which has its normally bottom portion inverted and glued with another two liter bottle which has its bottom half cut off, thereby the top portion of the second two liter bottle acts as the cone for the rocket 11. Of course, its conventional screw on cap should be positioned thereon to complete the construction of the cone, the latter may be charged with an appropriate weight substance. The rocket 11 is fitted, as by gluing, with a plurality of depending fins 26, usually three in number. The fins 26 provide stability during flight. As a matter of fact, if the fins 26 are glued at a slight angle from the vertical the rocket 11 will be given a spin during its flight.

The housing 9 is detailed to house the loose components of the rocket and its launch system and access may be obtained thereinto from the bottom through a door provided therefor . The housing 9 while horizontal is in its utilizable position, but may be carried vertically and handle 30 is supplied when carried in such a position. The handle 30 is positioned whereby the launcher is evenly balanced for ease of carrying.

Figure 2:
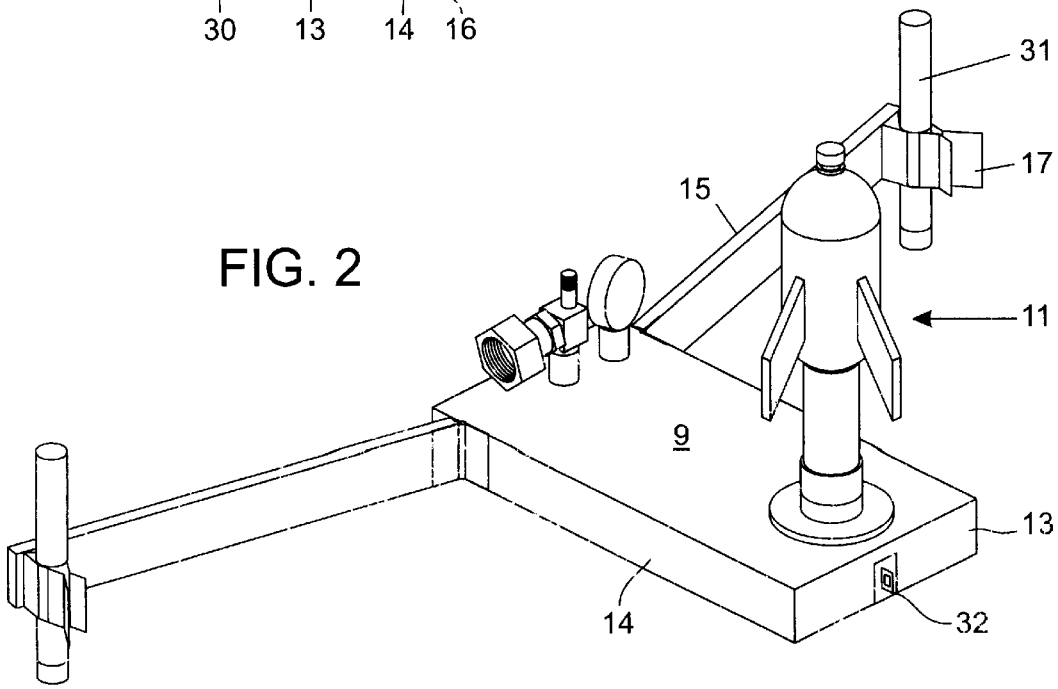
FIG. 2 is also a perspective of the rocket launcher and rocket in place with outriggers extended to form a tripod.
Figure 5:
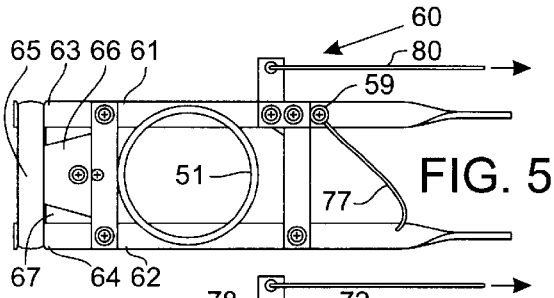
FIGS. 5, 6, 7, 8, 9, 10 and 11 are all top plan views of the trigger mechanism designed to hold the bottle in place and to abruptly release it when a lanyard is pulled from virtually any direction.
Figure 6:
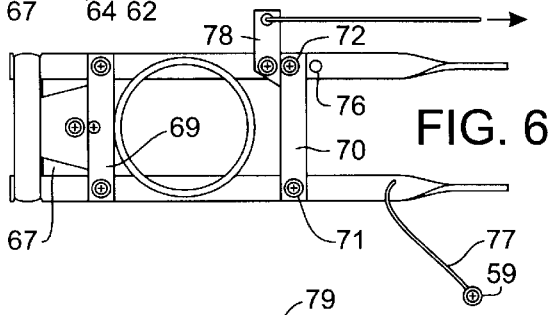

When the launcher is to be used for its rocket launching purposes, the housing 9 is positioned on a flat support surface such as the ground (not shown) and its outrigger legs 15 are release by disengaging brackets 17 from plate 18 and are angled outwardly as shown in FIG. 2. The spring loaded brackets 17 are detailed to retain vertically movable vertical tubes 31 which act as adjustable legs thereby resulting in an adjustable tripod wherein two points of the resulting tripod are movable; thereby providing for either vertical flight or flight inclined from the vertical in either direction.

As stated, the bottom of the housing 9 consists of a hinged door (not shown) thereby providing means to close the housing 9 and thereby retain the contents therein. A hasp 32 is seen at the end of the housing 9 as seen in FIG. 2, for securing the said door.

Attention is now directed to FIG. 3 for a detailed view of the conduit 23 and water-gas loading system. Note the male portion of a conventional water hose 40 connector and the female air pump connector 41 exploded from their respective connectors of Tee-connector 20. The Tee-connector 20 is supplied with pop-off safety valve 31 which is set for about 100 p.s.i., the said T-connector is supplied with a valve 31A to prevent back flow of water while air is pumped. Internally of the housing 9, is conduit 42 for supplying the water-gas mixture to an upstanding pipe 43 which terminates in a female threaded connector 44 which is a washer retainer. Connector 20 has a line check valve 56 prior to its feeding to conduit 42 for preventing back flow. Connector 44 has either an integral internal female thread or a bushing 44A therefor. The top of which has an annular surface. Standpipe 45 is fitted with an annular washer 41 at an upper end of threaded portion 46. The female connector 44 is detailed to accept a standpipe 45 having the male threaded end portion 46 thereon. The standpipe 45 is screwed into the female connector 44 to abutment with the said annular surface and extends upwardly and through neck 47 of the inverted bottle 27 for a distance up to near the top of the bottle 27. As the launcher is adapted to launch rockets employing bottles of various sizes the standpipe 45 may be of different lengths and may possess various diameters. A variety of pipes may be retained in the housing 9 and one selected and removed depending on the size of the bottle to be used in the configuring of the rocket.

The upstanding pipe 43 is positioned and spaced concentrically in a female threaded flange 50. The flange 50 is mounted above the surface of the housing 9 with annular spacers 55 therebetween and about screw that secure the flange to the housing 9. The flange 50 is fitted with an elongated tube 51. The tube 51 has a truncated male threaded portion 52 at one end and has slits 57 which are designed to provide a snug screwed on fit in the female thread 49 of flange 50. When assembled it resembles the showing thereof in FIG. 4, even though the latter shows an alternate embodiment in other details.

The tube 51 when assembled is also spaced and concentric with respect to standpipe 45. The end of tube 51 opposite the end with the male threads 52 is fitted with a retainer 60 which is detailed to clamp above conventional annular flange 48 of a soda bottle and thereby restrain it from take-off even though pressurized. More will be stated about the retainer 60 in regard to FIGS. 5–11.

To understand the detailed structure of the retainer 60 attention is directed to FIG. 3 and FIGS. 5–11. FIGS. 5–10 show the retainer from the top. It consists of a number of pieces beginning with two parallelly disposed elongated bars 61 and 62. It will be seen that the elongated bars extend through horizontally disposed slits in elongated tube 51. The end portions 63 and 64 are of bars 61 and 62 are fitted with spring means 65 which may be a number of rubber bands thereby providing tension to draw the said end portions 63 and 64 together so that given free rein upon the release of the retainer, the bars 61 and 62 are angled apart as displayed by FIGS. 10 and 11. The degree of angled outward movement of bars 61 an 62 is limited as the end portions of the bars 63 and 64 coming into abutment with trapezoid plate 66. Trapezoid plate 66 is mounted to a plate 67, generally rectangular in shape, the top surface portion of which can be seen in FIGS. 5, 6, 7, 8 and 9, and a different top surface portion, in FIGS. 10 and 11 however trapezoid plate 66 is substantially obscured by the end portions 63 and 64 when the said end portions are in either position in or out of abutment with the trapezoid plate 66.

The trapezoid plate 66 is very important for without it only one bar, either 61 or 62 would move outwardly. The trapezoid plate 66 has a number of attributes and functions. It insures that both bars 63 and 64 move outwardly in unison to release the rocket to prevent misfiring. It also prevents the bars 61 and 62 from being upset from the slits 53 and 54. It also reduces wear and tear on spring tension (rubber bands) by reducing amount of stretch travel.

The trapezoid plate 67 is integral with a downwardly extending flange portion 68 which is suitably connected to the elongated tube 51.

The bars 61 and 62 are pivotally connected to plate 69 which is horizontally perpendicular to the bars 61 and 62 and is positioned on one side of elongated tube 51.

The bars 61 and 62 are also connected by a pivot plate 70 which is at the opposite side of tube 51 and is also horizontally perpendicular to bars 61 and 62 and therefore parallel to plate 69. One end of pivot plate 70 is pivotally attached by a bolt 71 which is attached to bar 62. The other end of pivot plate 70 is hooked to an upstanding bolt 72 as pivot plate 70 has a hook 73 for the purpose. Bars 61 and 62 terminate at its ends 74 and 75 opposite to the spring means 65 containing end with a figure grasping surfaces whereby the bars 61 and 62 may be manually clamped towards one another and the pivot plate 70 is suitably hooked onto upstanding bolt 72. When the plate 70 is hooked into place the pivot plate 70 is held in place by retaining pin 59 which is inserted through hole 76. Pin 59 is tethered by string 77.

When the retaining pin 59 is removed from its hole 76 in bar 61 means is provided to disengage plate 70 from its hooked position around upstanding bolt 72. The means include a relatively small plate 78 which is pivotally secured at end portion to a bolt 81 thereof to bar 61 alongside upstanding bolt 72 and on the opposite side of hole 76. The small plate 78 extends angularly and horizontally beyond the bar 61. It has a hole 79 at the opposite end portion of plate 78.

A lanyard 80 is provided, which has a hook at one end that is connected to plate 78 by means of hole 79. In FIGS. 5, 6, 8 and 10 the lanyard 80 is pulled in the right direction with respect to the figures whereby plate 78 pivots clockwise around bolt 81.

Figure 7:
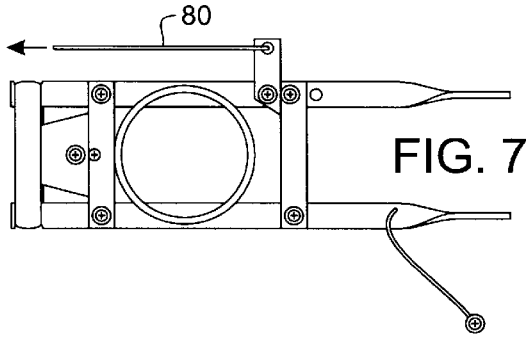
Figure 8:
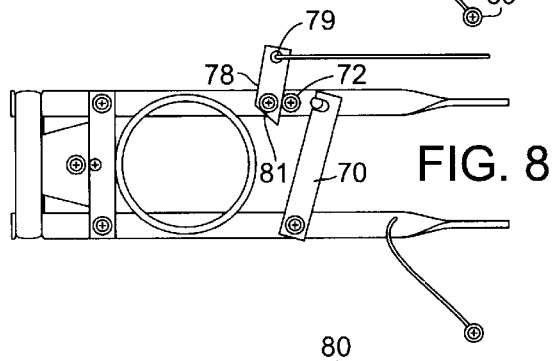
Figure 9:
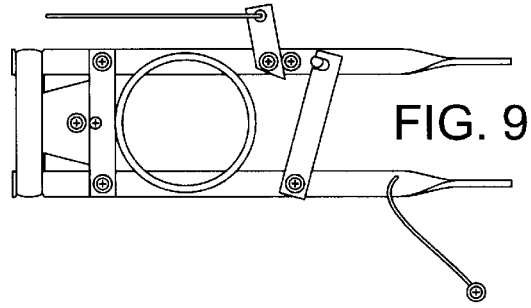
Figure 10:
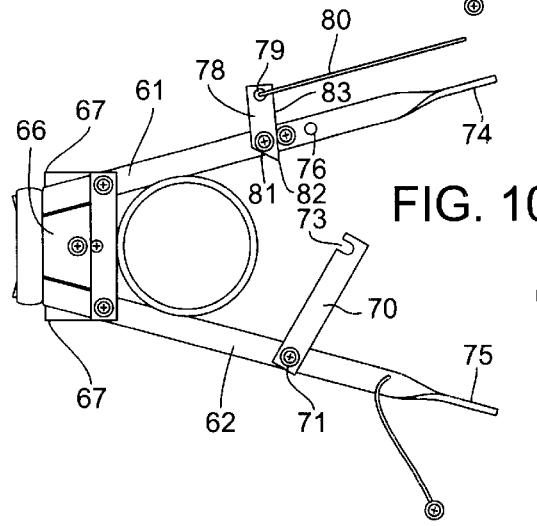
Figure 11:
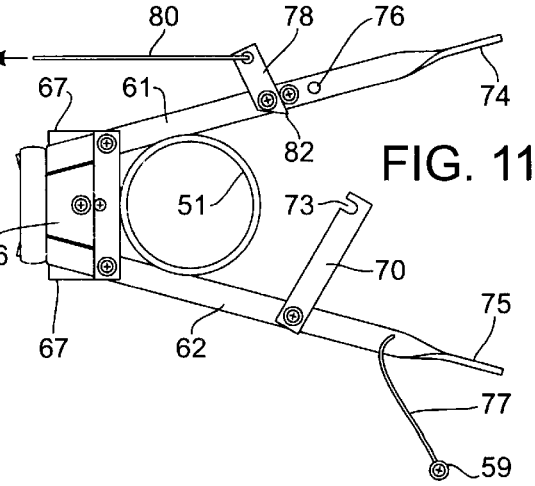

In FIGS. 7, 9 and 11 the lanyard 80 is pulled to the left of the respective drawings whereby the plate 78 pivots counterclockwise around bolt 81.

As the operational object is to release the plate 70 from its hooked position to thereby free the retainer, the retainer pin 59 is first removed from its position in hole 76. The lanyard 80 is then pulled. When its towards the left a point 82 on plate 78 pushes the plate 70 from its hooked position thereby releasing the clamping and retaining action. When towards the right a side 83 of plate 78 cams plate 70 out of its hooked position thereby releasing the clamping retainer.

Figure 12:
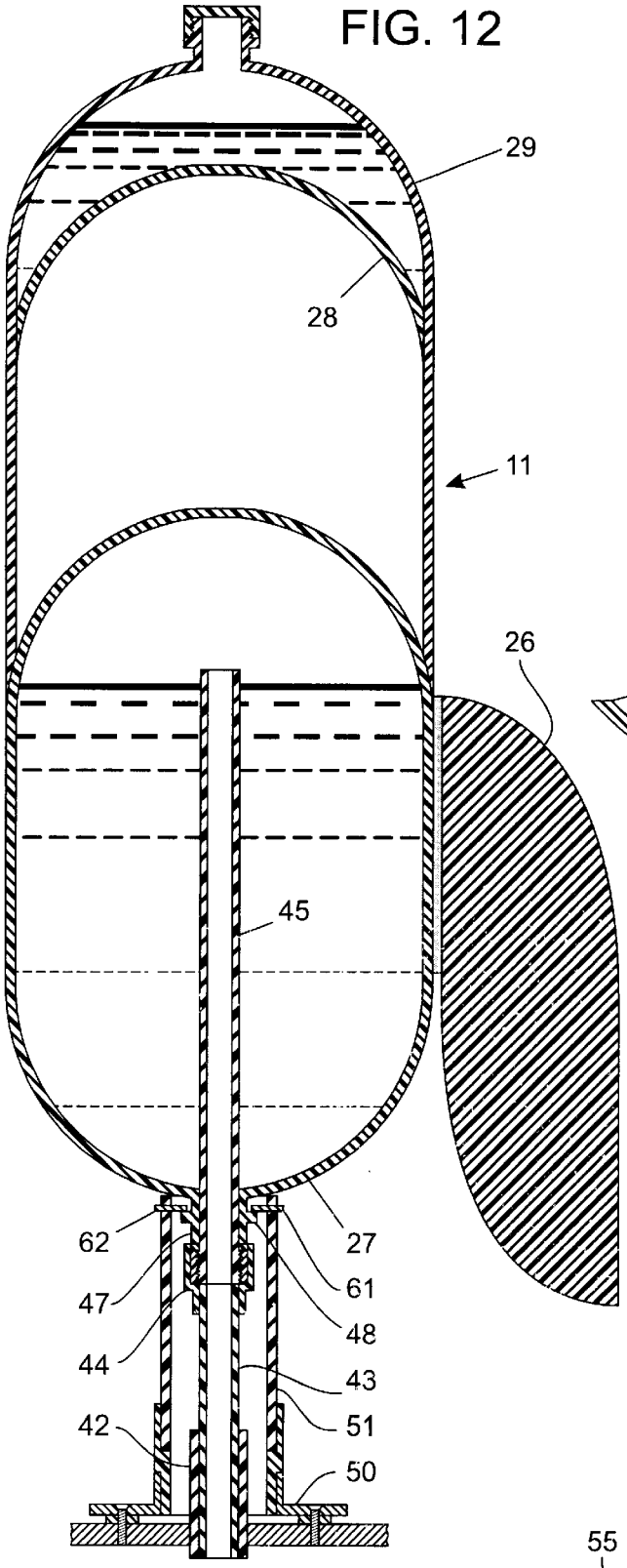
FIG. 12 is a cross-sectional view of the rocket in its launch position.
Figure 14:
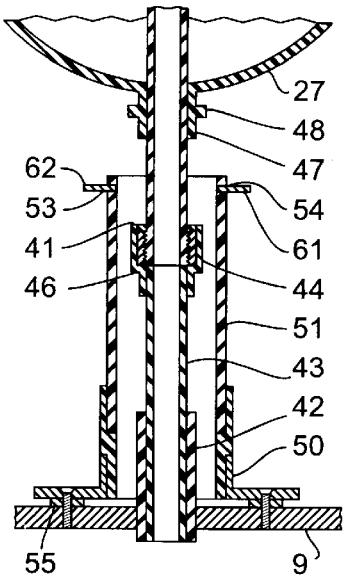
FIG. 14 is a cross-section and fragmentary portion of the rocket in its launching position.
Figure 13:
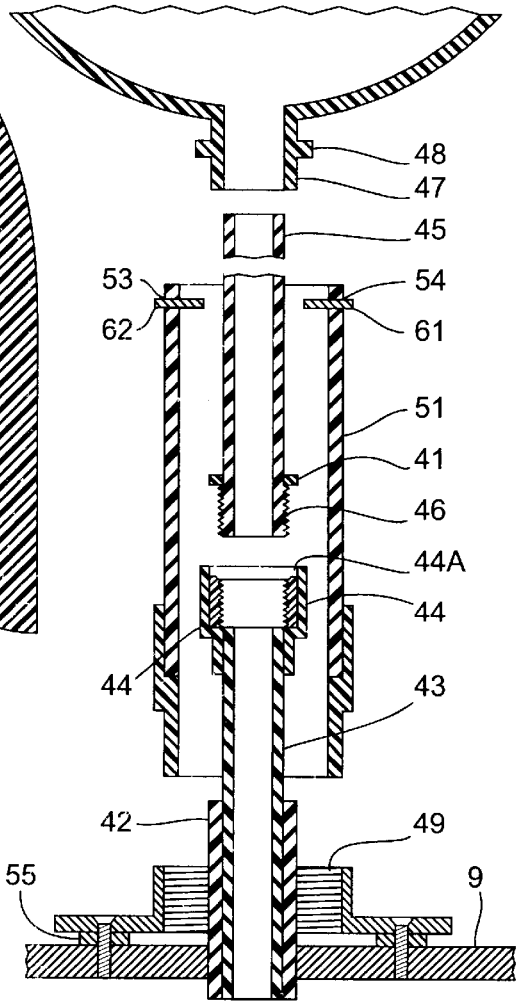
FIG. 13 is a similar but fragmented and exploded rocket being launched.

Attention is now directed to FIGS. 12–14, for a better understanding of the rocket and its immediate launching system. FIG. 12 is a cross section of the rocket 11. It is shown to possess a plurality of domes which is constructed from a number of soda bottles. The first inverted soda bottle 27 is seen to be inverted. Note that the soda bottle 27 is mounted and nested into a cut off portion of a second bottle 28 which in turn may be inserted and nested into a cut off portion of the top of a third bottle 29. Therefore in one embodiment the top most cut off soda bottle may be used in a non-inverted position whereby the top portion of a cut off soda bottle is employed and with its conventional screw-on cap in place presents a streamlined nose cone profile. As stated in the above, material may be added to the top of the rocket in bottle 29 for weight and the like.

In FIG. 12 the inverted bottle rocket with fins 26 is positioned atop elongate tube 51. In detail, prior to positioning of the bottle an appropriate standpipe 45 is selected if the bottle is a two liter soda bottle. The standpipe 45 is screwed into the female threads of connector 44 of upstanding, pipe 43. The standpipe 45 extends for a considerable distance above elongated tube 51. With the standpipe 45 in place, an empty two liter soda bottle is thrust downwardly onto standpipe 45 whereby the said pipe terminates internally in the bottle. The opening of the neck of the bottle rests on the annular washer 41 of the standpipe 45. The normally present flange 48 of the bottle is just below slits 53 and 54 at the upper end portion of elongated tube 51. Bars 61 and 62 of the retainer 60 are thrust into the slits 53 and 54 when the retainer is applied as seen in FIGS. 5–9. The underside bars 61 and 62 rest on the upwardly facing portion of flange 48, thereby restraining the entire rocket form upsetting therefrom.

The inverted bottle 27 is now in a position to be charged through conduit 42. Water is first introduced through conduit 42, through upstanding pipe 43, then through standpipe 45 which overflows out of the end thereof to fill the bottle 27. Thereafter, after the charging the inverted bottle with water the same conduits are used as a means to introduce pressurized air, the source of which has been stated to be a manual air pump. The pressurization should be increased until about a range of 50 p.s.i. to 125 p.s.i. is reached with about 100 p.s.i. being preferred. The rocket is now ready for launching, accomplished by the release of retainer 60 abut the flange in the manner described in the foregoing.

FIG. 13 shows an exploded view of the components shown assembled in FIG. 12. Note in FIG. 14 during assembly the bars 61 and 62 of retainer 60 are not yet in place in slits 53 and 54 of tube 51. The bottle 27 is in the process of being slid down standpipe 45.

While the preferred embodiment employs a manually operated hand air pump, it is within the purview of the invention that other sources of pressurized gas may be employed, e.g. a motorized air pump. It is also contemplated that a water and dry ice mixture be introduced into the inverted bottle 27. Attention is directed to FIG. 4 for such an embodiment. In place of the water carrying hose 40 which is coupled to female connector 21 a charging cylinder arrangement 33 may be employed. A cylinder 38 is charged with a quantity of water 39. Pellets of dry ice 35 in a quantity of about three to four ounces are introduced into the cylinder 38, thereafter the cylinder is sealingly closed with cap 36. The cylinder 38 is fluidly connected through a fluid connector 37 to a flexible conduit 38 which terminates in a conventional hose connector 40 which is affixed to female threaded connector 21 in the manner of the heretofore mentioned water hose. The water is driven from the cylinder by the pressure generated by the dry ice in the cylinder which also pressurizes the water introduced into the inverted bottle 27 much in the same manner as the use of air. The charging cylinder 38 is also supplied with a pop-off pressure valve 39A in the event the charging cylinder becomes over pressurized.

Novel other embodiments include the concept of introducing about one ounce of dry ice directly into the bottle 27 followed by invertion and insertion onto the standpipe 45 and applying of the retainer 60 as heretofore. Water is then introduced as inconnection with the preferred embodiment. In this embodiment the sublimation of the dry ice directly in the bottle 27 pressurizes the bottle.

In yet another embodiment, it is contemplated that the charging cylinder 38 be provided with a one-way charging valve 39B which may be in association with the pop-off pressure valve 39A through which air may be pumped into the charging cylinder 38 to drive previously introduced water into the inverted bottle 27 plus the pressurized air. The manner of adding the water to the rocket is especially useful under conditions when no water from a faucet and hose are readily available.

In another embodiment, the bottle 27 is first supplied with about one-half pound of baking soda and invertedly mounted onto standpipe 45 in the usual manner. The charging cylinder 38 is charged with vinegar or other solution of an organic acid, in a stoichiometric amount, and water. The charging cylinder 38 is then sealed and air is pumped thereinto whereby the vinegar and water mixture is introduced into the inverted bottle 27 where it acts to pressurize the bottle 27 with released carbon dioxide gas.

An important feature of the present invention is the fact that the standpipe 45 constituting the launch tube terminates above the level of the water as can be seen in FIG. 12. In the embodiment shown in FIG. 4 a 125 p.s.i. pop off valve 55A is supplied at the connection between conduit 23 and the gauge 24 whereby gas under pressure is released from the system without the concomitant loss of water from the rocket. The pop off valve 55A is at a higher rating than pop off valve 31.

In one embodiment plate 18 between brackets 17 are substituted with a U-shaped pipe assembly dimension whereby it bridges the space between brackets 17 when the outrigger legs 15 are folded towards one another as in FIG. 1.

In the instances when it is desired to use the launcher in a vertical position the brackets 17 are each clamped to the apex portions of a U-shaped members to thereby provide four point ground or floor support. By varying the angularity of the outrigger arms 15 from the housing 9 the horizontal position of standpipe 45 can be varied along a vertical to thereby accommodate various sizes of wheeled vehicles.

The construction of the present inventive toy is typically, of various types of plastic and, once the invention is appreciated, the selection of soft and hard plastics for various components will be within the skill of the artisan. For example, high density polyethylene may be used for certain aspects whereas other plastics may be utilized, for example, tubing could be typical vinyl tubing and the fittings could be hard rubber fittings or otherwise such as brass and the like. Additionally, some or all parts may be made of other materials such as materials typically available in the construction of toys including rigid and flexible foams metals, graphite, etc.

Obviously, numerous modifications and variations of the present invention are possible in light of the above teachings. It is therefore understood that within the scope of the appended claims, the invention may be practiced otherwise than as specifically described herein.

What is claimed is:

1. A liquid jet propelled rocket launcher and rocket toy, which comprises:

a launcher having a housing which has at least two legs hingedly secured at one end of said housing whereby said legs are capable of being angled outwardly substantially horizontally, each of the legs having bracket means at their opposite end for vertically adjustably retaining a vertical leg whereby said launcher may be tilted;

said launcher having upstanding a first fluid connector means and a second fluid connector means, said first connector means being adapted and constructed for a water supplying hose connection and said second connector means being adapted and constructed for an air supplying hose;

said first fluid connector and said second fluid connector means fluidly connected together to a fluid conduit;

said fluid conduit terminating near the other end of said housing in a vertical fluid conduit extending above said housing;

said vertical fluid conduit having a flange connector means on said housing concentric about said vertical fluid conduit, a first tube mounted in said flange connector means;

said vertical fluid conduit terminating below said first tube, said first tube being of a larger diameter than said vertical fluid conduit;

said first tube having a pair of horizontally disposed side slits oppositely disposed at substantially near an uppermost end portion of said first tube;

a releasable restraining means mounted about said uppermost end portion of said first tube and having elongated bar means which extends tangentially into each of said slits, said elongated bar means having spring means at oppositely disposed end portions adapted to tension said end portions together, a latch mechanism at substantially the other end of said bar means whereby to lock said bar means together under tension;

a standpipe vertically and fluidly connected to said vertical fluid conduit and extending above said first tube;

a rocket;

said rocket having a reservoir, said reservoir having a downwardly extending neck portion terminating in a mouth, said mouth being snugly concentric with said standpipe, said mouth extending into said first tube, said standpipe extending into said reservoir and terminating distally from said neck portion;

said neck portion having a radially outwardly extending flange;

said elongated bar means adapted and constructed to have portions thereof in contact with a portion of the upper surface of each flange on a side opposite to said mouth when said latch means is in latching condition whereby said releasable restraining means prevents vertical ascent of said rocket;

said latch mechanism being adapted and constructed whereby it may be unlatched by a lanyard which is attached thereto and may be pulled horizontally in opposite directions to remove the restraints on said rocket.

2. The rocket launcher and rocket toy of claim 1 wherein said fluid conduit has a pressure gauge and at least one safety valve.

3. The rocket launcher and rocket toy of claim 1 wherein said reservoir of said rocket is a thermoplastic bottle.

4. The rocket launcher and rocket toy of claim 3 wherein said thermoplastic bottle has an upwardly facing nose cone capable of being loaded.

5. A liquid jet propelled rocket launcher and rocket toy, which comprises:

a launcher having a housing which has at last two legs hingedly secured at one end of said housing whereby said legs are capable of being angled outwardly substantially horizontally, each of the legs having bracket means at their opposite ends for vertically adjustably retaining a vertical leg whereby said launcher may be tilted;

fluid connector means;

sealable reactor means;

said reactor means having a reactor fluid conduit means for conveying fluid to said fluid connector means;

said fluid connector means being fluidly connected to a launcher fluid conduit;

said launcher fluid conduit terminating near the other end of said housing in a vertical fluid conduit extending above said housing;

said vertical fluid conduit having a flange connector means on said housing concentric about said vertical fluid conduit, a first tube mounted in said flange connector means, said vertical fluid conduit terminating below said first tube, said first tube being of larger diameter than said vertical fluid conduit;

said first tube having a pair of horizontally disposed side slits oppositely disposed at substantially near an uppermost end portion of said first tube;

a releasable restraining means mounted about said uppermost end portion of said first tube and having elongated bar means which extends tangentially into each of said slits, said elongated bar means having spring means at oppositely disposed end portions adapted to tension said end portions together, a latch mechanism at substantially the other end of said bar means whereby to lock said bar means together under tension;

a standpipe vertically and fluidly connected to said vertical fluid conduit and extending above said first tube;

a rocket;

said rocket having a reservoir, said reservoir having a downwardly extending neck portion terminating in a mouth, said mouth being snugly concentric with said standpipe, said mouth extending into said first tube, said standpipe extending into said reservoir and terminating distally from said neck portion;

said neck portion having a radially outwardly extending flange, said elongated bar means adapted and constructed to have portions thereof in contact with a portion of the upper surface of each flange on a side opposite to said mouth when said latch means is in latching condition whereby said releasable restraining means prevents vertical ascent of said rocket;

said latch mechanism being adapted and constructed whereby it may be unlatched by a lanyard which is attached thereto and may be pulled horizontally in opposite directions to remove the restraints on said rocket.

6. The rocket launcher and rocket toy of claim 5 wherein said fluid conduit has a pressure gauge and at least one safety valve.

7. The rocket launcher and rocket toy of claim 5 wherein said reservoir of said rocket is a thermoplastic bottle.

8. The rocket launcher and rocket toy of claim 7 wherein said thermoplastic bottle has an upwardly facing nose cone capable of being loaded.

* * * * *